US011619891B2

(12) United States Patent
Fujii et al.

(10) Patent No.: US 11,619,891 B2
(45) Date of Patent: Apr. 4, 2023

(54) DEVELOPMENT UNIT, IMAGE FORMATION UNIT, AND IMAGE FORMATION APPARATUS INCLUDING DEVELOPER CARRIER AND LAYER REGULATION MEMBER

(71) Applicant: Oki Electric Industry Co., Ltd., Tokyo (JP)

(72) Inventors: Masashi Fujii, Tokyo (JP); Yoshihiro Goto, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/392,968

(22) Filed: Aug. 3, 2021

(65) Prior Publication Data

US 2022/0128928 A1 Apr. 28, 2022

(30) Foreign Application Priority Data

Oct. 27, 2020 (JP) ..... JP2020-179381

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
See application file for complete search history.

(56) References Cited

U.S. PATENT DOCUMENTS 8,290,410 B2 * 10/2012 Lee ..... G03G 15/0812 399/284
8,995,891 B2 * 3/2015 Itabashi ..... G03G 21/1821 399/284
9,427,825 B2 * 8/2016 Yokoi ..... B23K 26/22
9,500,994 B2 * 11/2016 Brown ..... G03G 15/0812
10,684,584 B1 * 6/2020 Iriyama ..... G03G 15/0812

FOREIGN PATENT DOCUMENTS

JP 06337578 A * 12/1994
JP 2008-89808 A 4/2008
JP 2008089656 A * 4/2008

* cited by examiner

*Primary Examiner* — Walter L Lindsay, Jr.
*Assistant Examiner* — Milton Gonzalez
(74) *Attorney, Agent, or Firm* — Metrolex IP Law Group, PLLC

(57) ABSTRACT

A development unit according to an embodiment may include a developer carrier configured to carry developer on a surface thereof; a layer regulation member being elongate in a direction and provided facing the developer carrier; and a frame supporting the developer carrier and the layer regulation member. The layer regulation member comprises a metal blade that contacts the developer carrier and a support member attached to the frame and supporting the blade. A free length of the blade at an end portion in a longitudinal direction of the layer regulation member is shorter than a free length of the blade at a center portion in the longitudinal direction of the layer regulation member.

10 Claims, 14 Drawing Sheets

DEVELOPMENT UNIT, IMAGE FORMATION UNIT, AND IMAGE FORMATION APPARATUS INCLUDING DEVELOPER CARRIER AND LAYER REGULATION MEMBER

CROSS REFERENCE TO RELATED APPLICATIONS

This application claims priority based on 35 USC 119 from prior Japanese Patent Application No. 2020-179381 filed on Oct. 27, 2020, entitled "DEVELOPMENT UNIT, IMAGE FORMATION UNIT, AND IMAGE FORMATION APPARATUS", the entire contents of which are incorporated herein by reference.

BACKGROUND

The disclosure may relate to a development unit, an image formation unit, and an image formation apparatus using an electrophotographic method.

In a related art, an image formation apparatus using an electrophotographic method is provided with a development unit configured to develop a latent image. The development unit includes a developer carrier that carries toner as a developer, and an elongated layer regulation member that regulates thickness of a toner layer on the surface of the developer carrier. The layer regulation member includes a metal blade that is pressed against the surface of the developer carrier (for example, Japanese Patent Application Publication No. 2008-89808 (see FIG. 1)).

SUMMARY

However, at end portions of the layer regulation member in a longitudinal direction of the layer regulation member, a contact force of the blade against the developer carrier tends to be reduced. In the areas where the contact force of the blade is reduced, the thickness of the toner layer on the surface of the developer carrier becomes thicker, which may cause unevenness in image density.

An object of an embodiment of the disclosure may be to suppress reduction in a contact force of a blade of a layer regulation member against a developer carrier at longitudinal end portions of the layer regulation member, thereby reducing unevenness in image density.

A first aspect of the disclosure may be a development unit that may include: a developer carrier configured to carry developer on a surface thereof; a layer regulation member being elongate in a direction and provided facing the developer carrier; and a frame supporting the developer carrier and the layer regulation member, wherein the layer regulation member comprises a metal blade that contacts the developer carrier and a support member attached to the frame and supporting the blade, and a free length of the blade at an end portion in a longitudinal direction of the layer regulation member is shorter than a free length of the blade at a center portion in the longitudinal direction of the layer regulation member.

A second aspect of the disclosure may be a development unit that may include: a developer carrier configured to carry developer on a surface thereof; a layer regulation member being elongate in a direction and provided facing the developer carrier; and a frame supporting the developer carrier and the layer regulation member, wherein the layer regulation member comprises a metal blade that contacts the developer carrier and a support member attached to the frame and supporting the blade, flexural rigidity of the blade at an end portion in a longitudinal direction of the layer regulation member is greater than flexural rigidity of the blade at a center portion in the longitudinal direction of the layer regulation member, and a length of a portion of blade that contacts the developer carrier is shorter than a length of the surface of the developer carrier in the longitudinal direction.

A third aspect of the disclosure may be a development unit that may include: a developer carrier configured to carry developer on a surface thereof; a layer regulation member being elongate in a direction and provided facing the developer carrier; and a frame supporting the developer carrier and the layer regulation member, wherein the layer regulation member comprises a metal blade that contacts the developer carrier and a support member attached to the frame and supporting the blade, and a deflection amount of the blade at an end portion in a longitudinal direction of is greater than a deflection amount of the blade at a center portion in the longitudinal direction of the layer regulation member.

According to any one of the above aspects, it is possible to suppress the reduction in the contact force of the blade against the developer carrier at the longitudinal end portion of the layer regulation member. This can reduce unevenness in image density.

DETAILED DESCRIPTION

Figure 1:
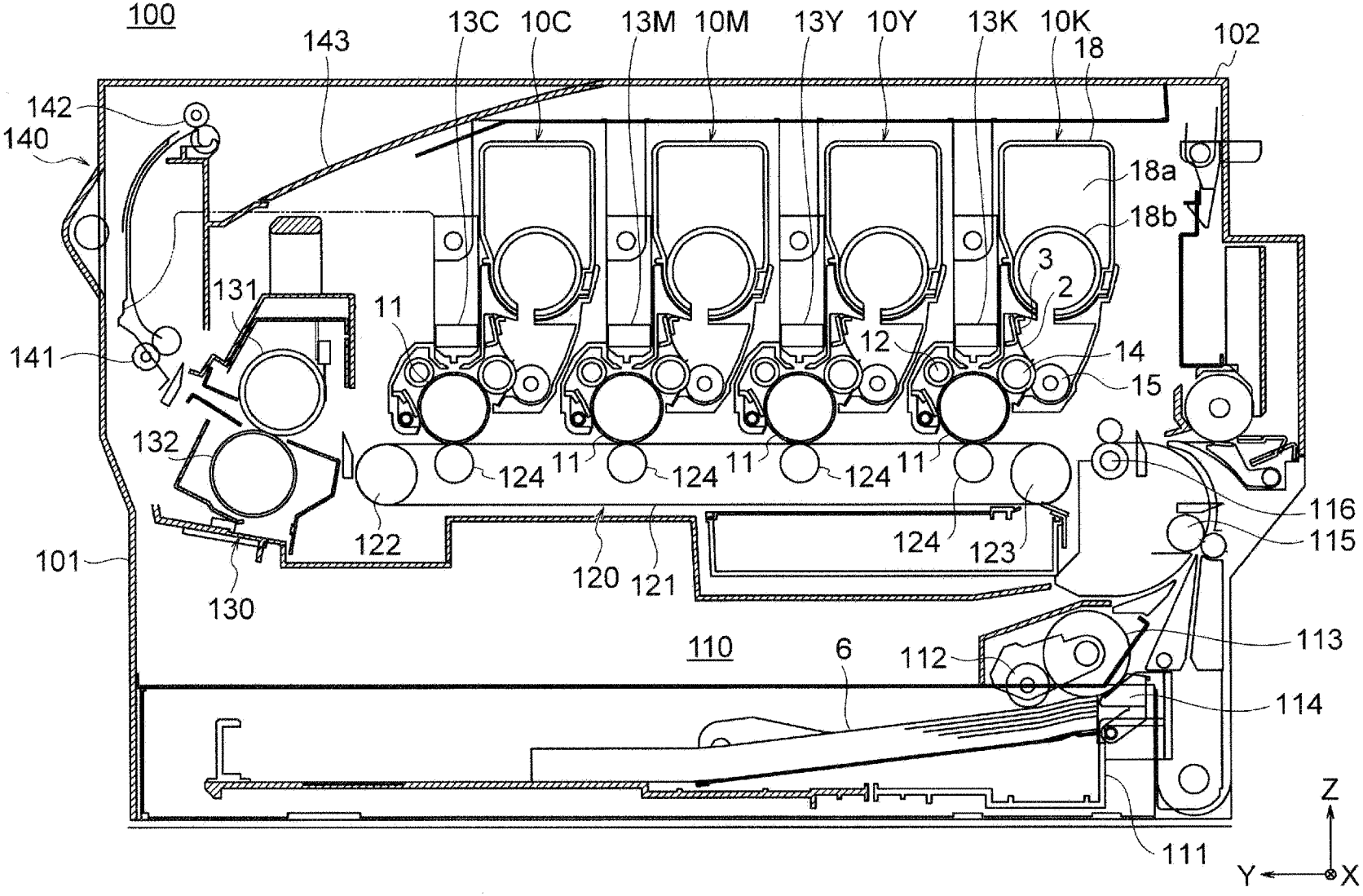
FIG. 1 is a diagram illustrating a view of a basic configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment (Image Formation Apparatus)

First, an image formation apparatus according to a first embodiment is described. FIG. 1 is a diagram illustrating a view of an image formation apparatus 100 according to a first embodiment. The image formation apparatus 100 is configured to form an image by an electrophotographic method, and is, for example, a color printer.

The image formation apparatus 100 includes a medium supply unit 110 that supplies a medium 6, process units 10K, 10Y, 10M, and 100 as image formation units that form toner images (developer images) of black (K), yellow (Y), magenta (M), and cyan (C), a transfer unit 120 that transfers the toner images to the medium 6, a fixation unit 130 that fixes the toner images on the medium 6, and a medium discharge unit 140 that discharges the medium 6.

These components are housed in a housing 101. At an upper part of the housing 101, a top cover 102 which can be opened and closed is provided. The medium 6 is, for example, printing paper, an OHP sheet, an envelope, copy paper, special paper, etc.

The medium supply unit 110 includes a medium tray 111 accommodating therein the media 6 in a stacked manner, a pickup roller 112 in contact with the uppermost one of the media 6 accommodated in the medium tray 111, a feed roller 113 provided in the vicinity of the pickup roller 112, and a separation pad 114 provided being opposed to the feed roller 113.

The pickup roller 112 rotates with being in contact with the medium 6 on the medium tray 111, and thereby takes out the medium 6 from the medium tray 111. The feed roller 113 feeds the medium 6 that is taken out by the pickup roller 112 to a medium conveyance path. The separation pad 114 applies a conveyance resistance to the media 6 to prevent overfeeding of the media 6.

The medium supply unit 110 also includes, along the medium conveyance path, a conveyance roller pair 115 and a conveyance roller pair 116. The conveyance roller pair 115 includes a resist roller and a pinch roller. The conveyance roller pair 115 corrects the skew of the medium 6 when the leading end of the medium 6 comes in contact with a nip of the rollers, and then starts rotating at a predetermined time after the leading end of the medium 6 comes in contact with the rollers, so as to convey the medium 6. The conveyance roller 116 includes a pair of rollers and conveys the medium 6 from the conveyance roller 115 to the transfer unit 120.

The process units 10K, 10Y, 10M, and 100 are arranged from upstream to downstream (from right to left in FIG. 1) along the medium conveyance path.

Above the process units 10K, 10Y, 10M, and 100, exposure heads 13K, 13Y, 13M, and 13C as print heads are disposed so as to face photosensitive drums 11 (described later), respectively. The exposure heads 13K, 13Y, 13M, and 13C are suspended and supported by the top cover 102.

Since the process units 10K, 10Y, 10M, and 100 have a common configuration, the units are referred to as "process unit 10" below. Similarly, the exposure heads 13K, 13Y, 13M and 13C are referred to as "exposure head 13".

Figure 2:
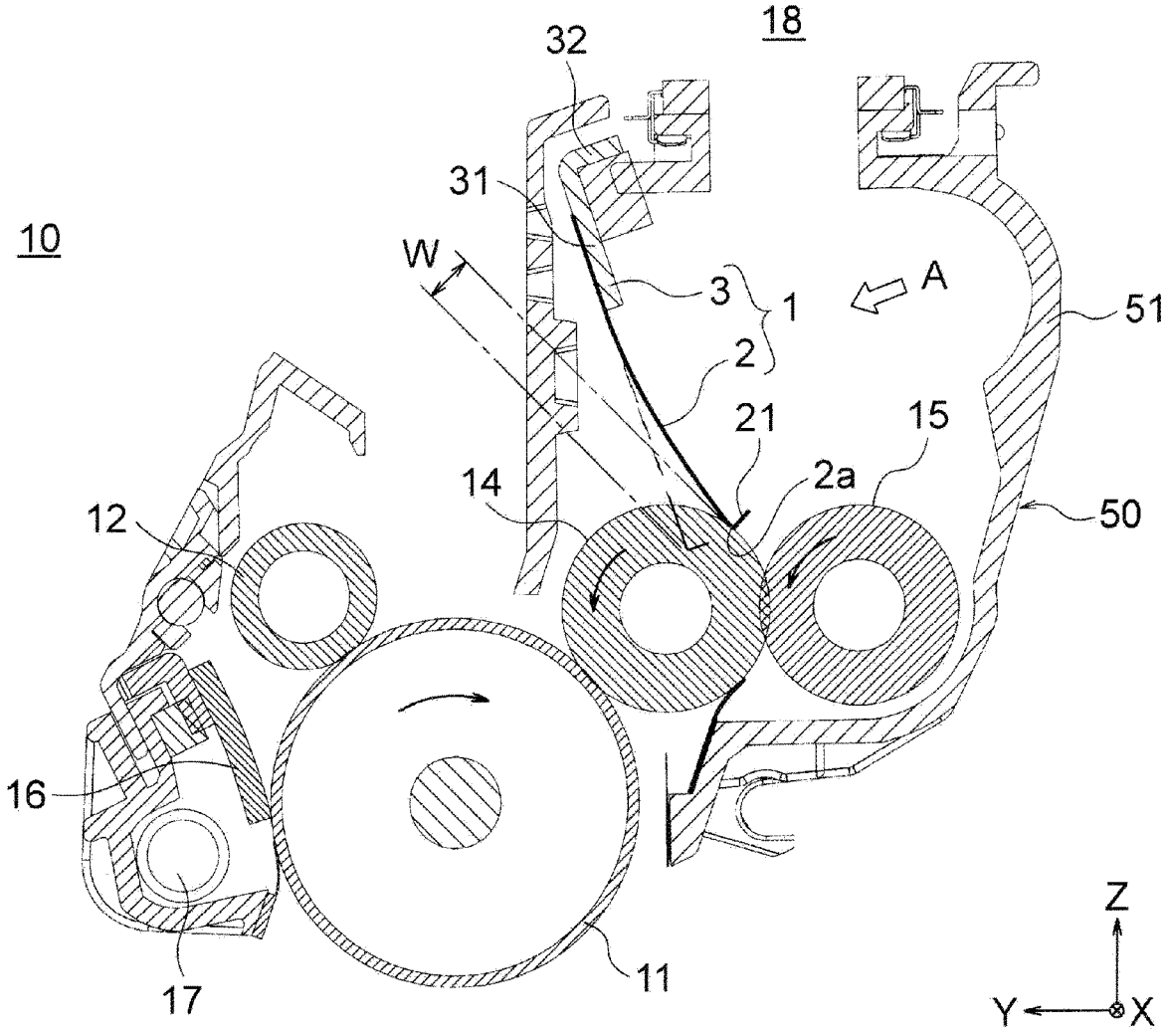
FIG. 2 is a diagram illustrating a cross sectional view of a main part of a process unit according to a first embodiment.

FIG. 2 is a diagram illustrating a cross sectional view of the process unit 10. As illustrated in FIG. 2, the process unit 10 includes a photosensitive drum 11 as an image carrier. The photosensitive drum 11 is formed with photosensitive layers (a charge generation layer and a charge transport layer) layered on the surface of a conductive base body. The photosensitive drum 11 is rotated in the rotational direction (a clockwise direction in FIG. 1).

The process unit 10 further includes a charging roller 12 as a charging member, a development roller 14 as a developer carrier, a supply roller 15 as a feeding member, a layer regulation member 1 as a layer regulation member, a cleaning member 16, and a unit frame 51 accommodating the above.

The charging roller 12 is disposed to be in contact with the surface of the photosensitive drum 11 and is configured to rotate along with the rotation of the photosensitive drum 11. The charging roller 12 is applied with a charging voltage to uniformly charge the surface of the photosensitive drum 11. The exposure head 13 exposes light onto the uniformlycharged surface of the photosensitive drum 11, so as to form an electrostatic latent image on the photosensitive drum 11.

The development roller 14 is disposed so as to contact the surface of the photosensitive drum 11 and rotates in the opposite direction to the photosensitive drum 11. The development roller 14, to which a developing voltage is applied, attaches toner to the electrostatic latent image formed on the surface of the photosensitive drum 11 to form a toner image.

The supply roller 15 is disposed so as to contact or face the surface of the development roller 14 and rotates in the same direction as the development roller 14. The supply roller 15 is applied with a supply voltage and supplies toner to the development roller 14.

The layer regulation member 1 includes a blade 2 pressed against the surface of the development roller 14 and a holder 3 attached to the unit frame 51 and supporting the blade 2. The layer regulation member 1 regulates the thickness of the toner layer (developer layer) formed on the surface of the development roller 14.

The cleaning member 16 is a blade or a roller arranged to contact the surface of the photosensitive drum 11. The cleaning member 16 scrapes off the toner remaining on the surface of the photosensitive drum 11 after transfer. Under the cleaning member 16, a conveyance spiral 17 is provided to convey waste toner scraped off by the cleaning member 16.

On the upper part of the unit frame 51, a toner cartridge 18 as a developer housing is mounted. As illustrated in FIG. 1, the toner cartridge 18 has a toner housing section 18*a* for storing toner and a toner supply port that is opened and closed by a shutter 18*b*. The toner cartridge 18 supplies toner to the toner chamber above the development roller 14 and the supply roller 15.

As illustrated in FIG. 1, the transfer unit 120 includes a transfer belt 121 which runs as adsorbing the medium 6, and a drive roller 122 and a tension roller 123 on which the transfer belt 121 is stretched across. The drive roller 122 is rotated in the counterclockwise direction in the figure to run (convey) the transfer belt 121.

The transfer unit 120 also includes a transfer roller 124 as a transfer member disposed opposite to the photosensitive drum 11 of each process unit 10 via a transfer belt 121. A transfer voltage is applied to the transfer roller 124 to transfer the toner image of each color formed on the photosensitive drum 11 to the medium 6 on the transfer belt 121.

The fixation unit 130 includes a fixation roller 131 including a heat source and a pressure roller 132 that forms a nip with the fixation roller 131. The fixation roller 131 and the pressure roller 132 apply heat and pressure to the toner image to fix the image on the medium 6 as the medium 6 passes through the nip.

The medium discharge unit 140 includes a discharging roller pair 141 and a discharging roller pair 142 that convey the medium 6 having passed through the fixation unit 130 and discharges the medium 6 from a discharge port. The top cover of the image formation apparatus 100 is formed with a stacker 143 on which the media 6 discharged by the discharging roller pairs 141 and 142 are stacked and accumulated.

In FIG. 1, the axial direction of the photosensitive drum 11 and each roller is defined as the X direction. The X direction is also the width direction of the medium 6. The direction of movement of the medium 6 passing through the process units 10K, 10Y, 10M, 100 is the Y direction. The direction orthogonal to the XY plane is referred to as the Z direction. In the example illustrated in FIG. 1, the XY plane is a horizontal plane and the Z direction is a vertical direction.

Figure 3:
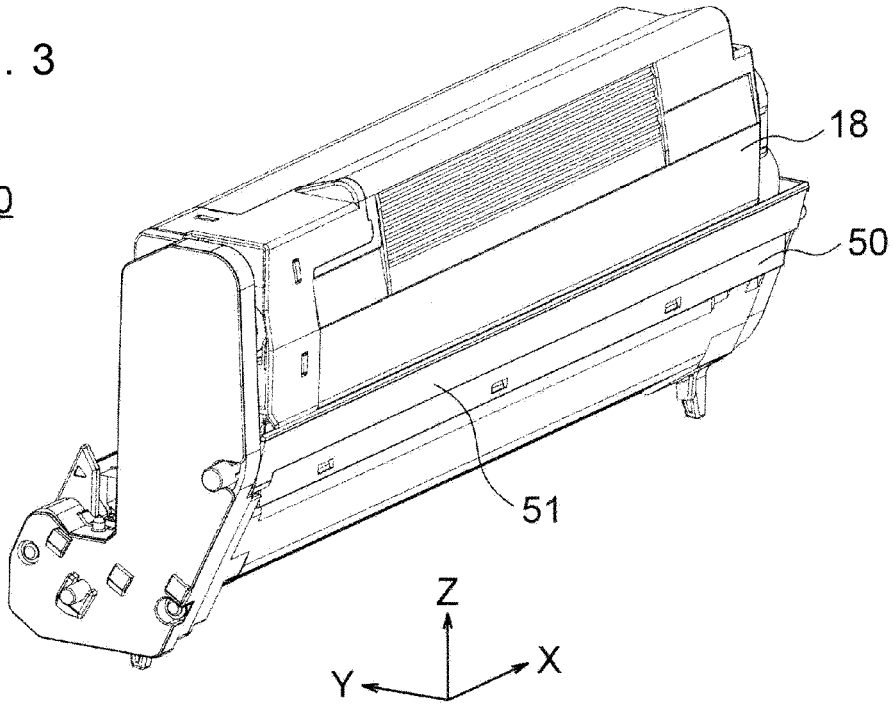
FIG. 3 is a diagram illustrating a perspective view of the process unit according a first embodiment.
Figure 4:
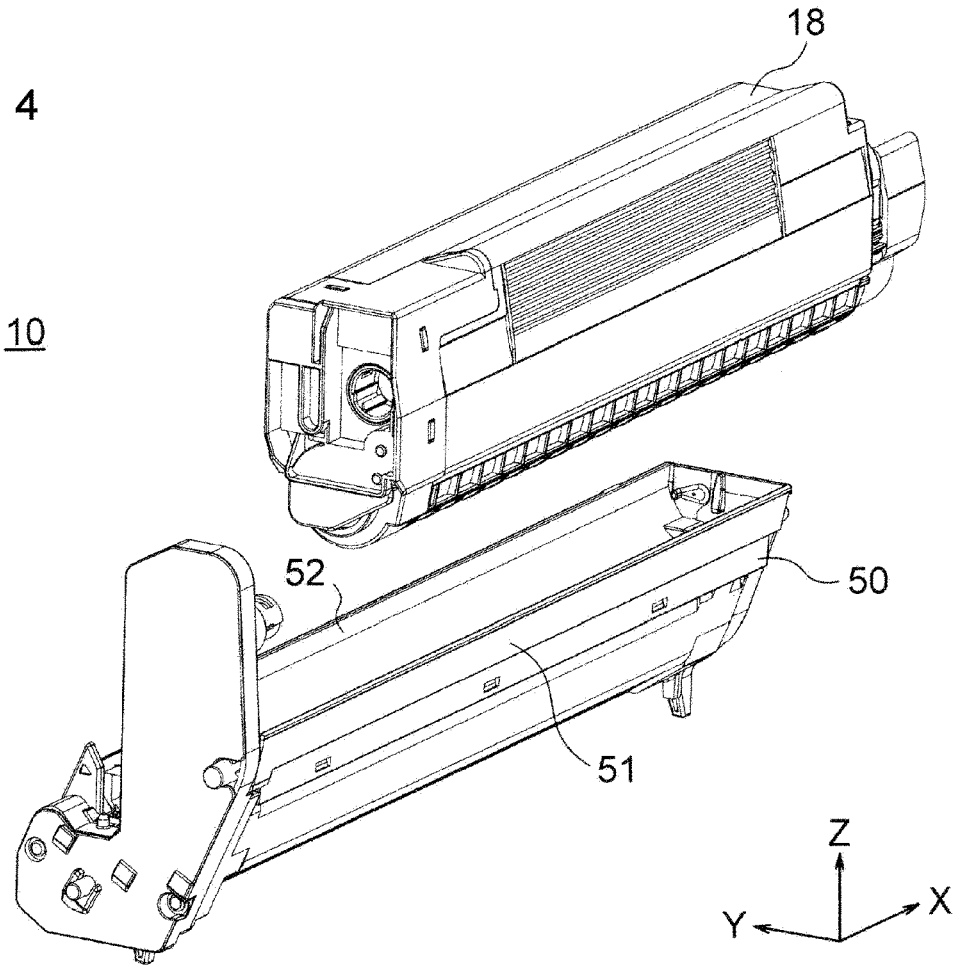
FIG. 4 is a diagram illustrating an exploded perspective view of the process unit according to a first embodiment.

FIG. 3 is a diagram illustrating a perspective view of the process unit 10. FIG. 4 is a diagram illustrating a perspective view of the process unit 10. As illustrated in FIG. 3, the process unit 10 includes a development unit 50 and the toner cartridge 18.

As illustrated in FIG. 4, the development unit 50 includes the unit frame 51 described above. The unit frame 51 includes an opening 52 at the top, and the toner cartridge 18 is detachably mounted in the opening 52.

A unit including the development roller 14, the supply roller 15, and the layer regulation member 1 (i.e., components contributing to the development of a latent image on the surface of the photosensitive drum 11) and the unit frame 51 accommodating the above is referred to as the development unit 50.

A unit incorporating at least the photosensitive drum 11 (specifically, the photosensitive drum 11, the charging roller 12, the cleaning member 16, and the conveyance spiral 17) in the development unit 50 is referred to as the process unit 10. The process unit 10 is also referred to as an image formation unit or an image drum unit.

(Layer Regulation Member)

Figure 5:
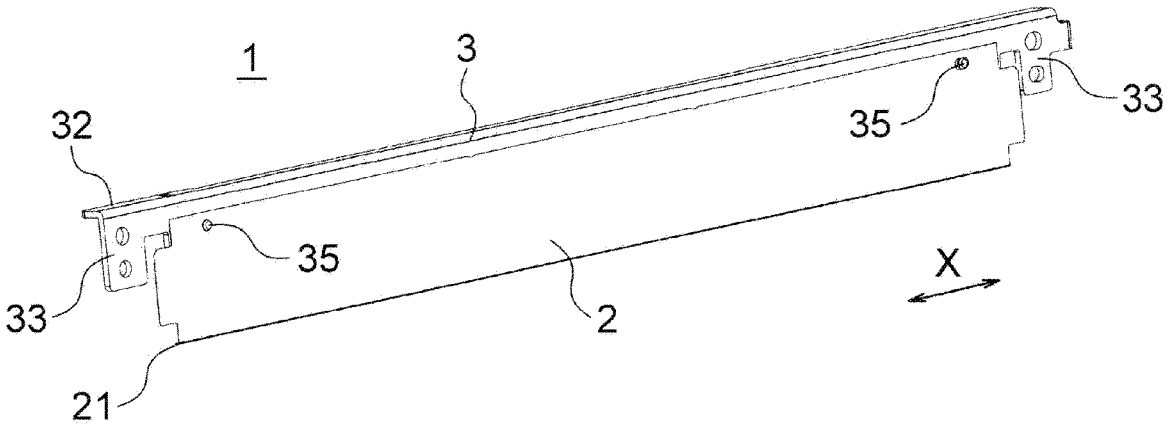
FIG. 5 is a diagram illustrating a perspective view of a layer regulation member according to a first embodiment.

FIG. 5 is a diagram illustrating a perspective view of the layer regulation member 1. The layer regulation member 1 is elongate in the axial direction, i.e., the X direction, of the development roller 14 (FIG. 2). The layer regulation member 1 includes a blade 2 and a holder 3 as a support or a support member that supports the blade 2.

The blade 2 and the holder 3 are both elongate in the X direction. In other words, the longitudinal direction of the layer regulation member 1, the longitudinal direction of the blade 2, and the longitudinal direction of the holder 3 are all in the same direction. Similarly, the width direction of the layer regulation member 1 (orthogonal to the longitudinal direction), the width direction of the blade 2, and the width direction of the holder 3 are all in the same direction.

Figure 6:
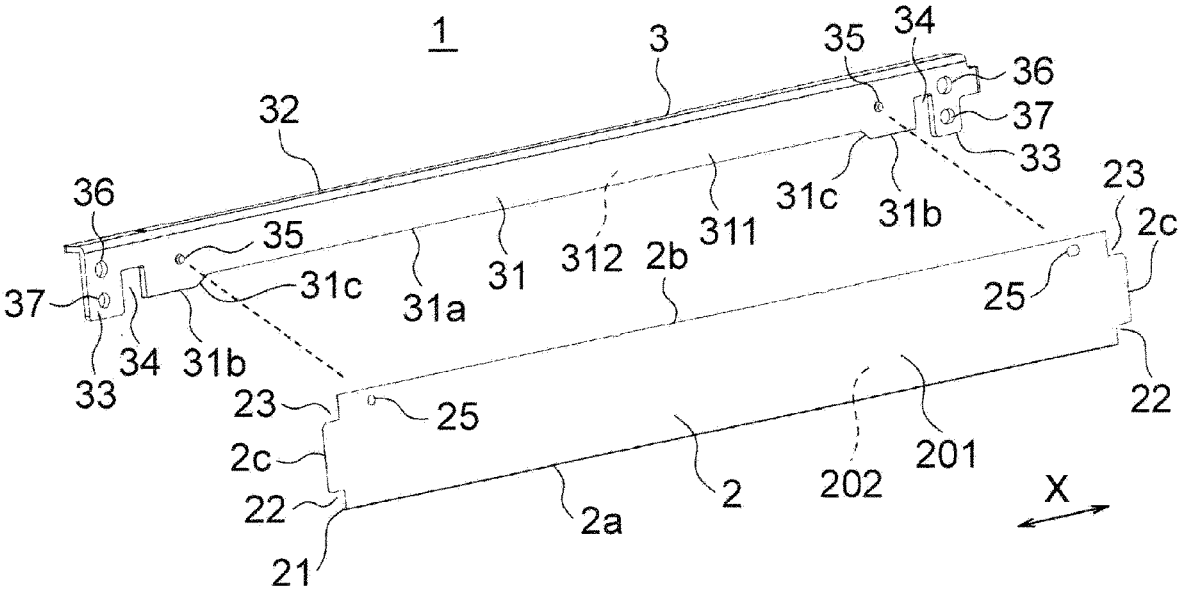
FIG. 6 is a diagram illustrating an exploded perspective view of the layer regulation member according to a first embodiment.

FIG. 6 is a diagram illustrating an exploded perspective view of the layer regulation member 1. The blade 2 is formed of a thin metal plate having a thickness of about 0.1 mm. The metal forming the blade 2 is, for example, but not limited to, stainless steel.

The blade 2 has a substantially rectangular shape that is elongate in the X direction. The blade 2 includes a free end 2*a* (a distal end) and a base end 2*b* (proximal end) corresponding to the two long sides of the rectangle, and a pair of longitudinal ends 2*c* corresponding to the two short sides of the rectangle.

The free end 2*a* of the blade 2 contacts the development roller 14 (FIG. 2). A bent portion 21 (FIG. 2), which is bent substantially orthogonally from a main body of the blade 24, is formed in the free end 2*a* of the blade 2. The bent portion 21 extends from the free end 2*a* in a direction away from the surface of the development roller 14. On the other hand, the base end 2*b* of the blade 2 is located on a flat plate portion 31 (described below) of the holder 3.

The blade 2 is formed with notches 22 at both longitudinal end portions of the free end 2*a*, that is, at the corners between the free end 2*a* and each longitudinal end 2*c* (each short sides 2*c*). The blade 2 is also formed with notches 23 at both longitudinal end portions of the base end 2*b*, that is, at the corners between the base end 2*b* and each longitudinal end 2*c* (each short sides 2*c*).

The blade 2 includes an opposing surface 201 facing the development roller 14 (FIG. 2) and an attachment surface 202 on the opposite side of the opposing surface 201. The attachment surface 202 of the blade 2 is a surface that is fixed (attached) to the flat plate portion 31 (described below) of the holder 3.

The holder 3 is made of metal and has an L-shaped cross-sectional shape in a plane orthogonal to the longitudinal direction. The holder 3 includes the flat plate portion 31 having a substantially rectangular shape and a bent portion 32 extending along one long side of the flat plate portion 31. The flat plate portion 31 is fixed (attached) to an unillustrated attachment portion of the unit frame 51.

The holder 3 includes a pair of notches 34 at both sides of the flat plate portion 31 in the longitudinal direction of the holder 3. The notch 34 extends in the width direction of the holder 3 from the side (edge) of the flat plate portion 31 opposite to the side (edge) having the bent portion 32.

The holder 3 also includes a pair of mounting pieces 33 on outer sides of the notches 34 in the longitudinal direction of the holder 3. Each of the mounting pieces 33 includes a through hole 36 and a positioning hole 37. The positioning holes 37 are engaged with positioning projections (not illustrated) formed in the unit frame 51. The through hole 36 is a hole in which a screw (not illustrated) for fixing the holder 3 to the unit frame 51 is inserted.

The flat plate portion 31 of the holder 3 includes an attachment surface 311 to which the blade 2 is fixed and a back surface 312 on the opposite side of the attachment surface 311. The attachment surface 311 and the back surface 312 are both flat surfaces. To the attachment surface 311 of the holder 3, the attachment surface 202 of the blade 2 is fixed.

The flat plate portion 31 of the holder 3 includes, on a long side (an edge) opposite to a long side (an edge) including the bent portion 32 in the widthwise direction of the flat plate portion 31, a first support edge portion 31*a* and a second support edge portions 31*b*. The first support edge portion 31*a* is located at the longitudinal center portion of the holder 3. The second support edge portions 31*b* are located at both longitudinal end portions of the holder 3.

The first support edge portion 31*a* and the second support edge portions 31*b* are edge portions that serve as fulcrum points for flexion when the blade 2 fixed to the flat plate portion 31 flexes. The second support edge portions 31*b* protrude in the width direction of the holder 3 more than the first support edge portion 31*a*.

Inclined edge portions 31*c* are formed between the first support edge portion 31*a* and the second support edge portions 31*b* in the longitudinal direction of the holder 3. In other words, the flat plate portion 31 of the holder 3 has a shape in which there is no sudden level changes in width between the central portion in the longitudinal direction and the end portions in the longitudinal direction.

A pair of projections 35 are formed on the attachment surface 311 of the flat plate portion 31. The projections 35 are engaged with the holes 25 formed in the blade 2. The engagement of the projections 35 with the holes 25 positions the blade 2 with respect to the holder 3.

The blade 2 is fixed to the holder 3, for example, by welding. In this case, it may be preferable to weld the blade 2 at a plurality of locations in the longitudinal direction of the blade 2 with the holes 25 of the blade 2 engaged with the projections 35 of the holder 3. However, the fixing of the blade 2 to the holder 3 is not limited to welding, but may be fixed, for example, by screws or the like.

By fixing the blade 2 to the flat plate portion 31 of the holder 3, the layer regulation member 1 illustrated in FIG. 5 is constituted. The blade 2 protrudes in the width direction from the first support edge portion 31*a* and the second support edge portions 31*b* of the holder 3.

By fitting the positioning holes 37 of the holder 3 with the projections (not illustrated) of the unit frame 51 (FIG. 2) and screwing screws through the through holes 36 into the screw holes (not illustrated) of the unit frame 51, the layer regulation member 1 is attached to the unit frame 51.

As illustrated in FIG. 2, when the layer regulation member 1 is mounted on the unit frame 51, the free end 2*a* of the blade 2 contacts the surface of the development roller 14, and the blade 2 is deflected by a deflection amount W.

The deflection amount W of the blade 2 is the distance between a position of the free end 2*a* of the blade 2 in a state where the blade 2 extends in a straight line (indicated by the dashed line in FIG. 2) and a position of the free end 2*a* of the blade 2 in a state where the blade 2 is in contact with and deflected by the surface of the development roller 14.

Figure 7A:
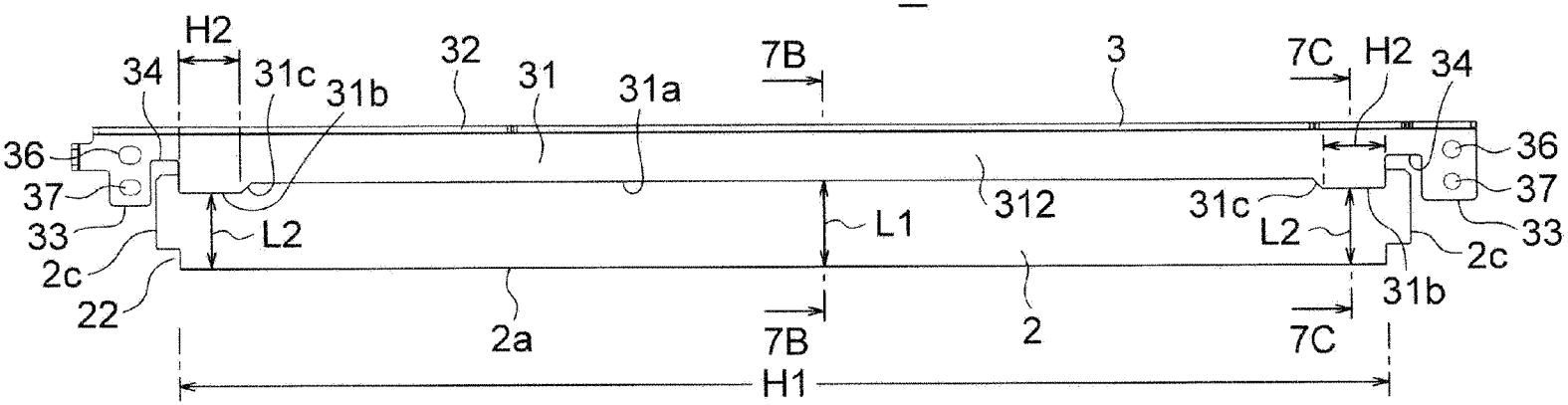
FIG. 7A is diagram illustrating a front view of the layer regulation member according to a first embodiment.
Figure 7C:
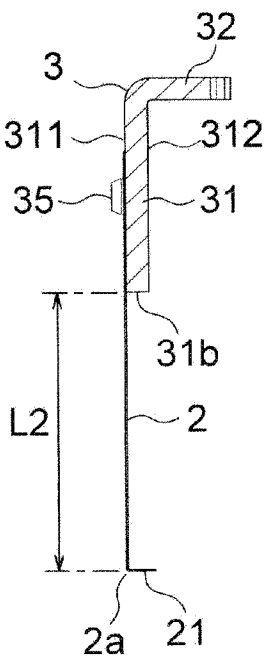
FIG. 7C is a diagram illustrating a cross sectional view of an end portion of the layer regulation member according to a first embodiment.
Figure 7B:
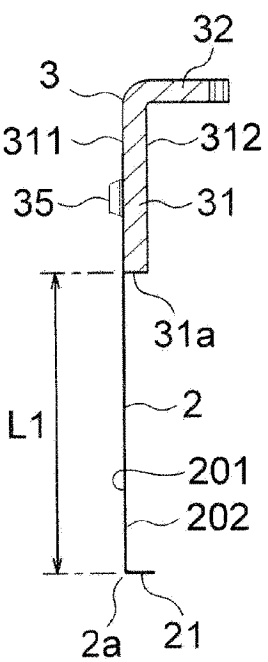
FIG. 7B is a diagram illustrating a cross sectional view of a center portion of the layer regulation member according to a first embodiment.

FIG. 7A is a view of the layer regulation member 1 as seen in the direction indicated by the arrow A in FIG. 2. FIG. 7B is a diagram illustrating a cross sectional view taken along the line 7B-7B in FIG. 7A, and FIG. 7C is a diagram illustrating a cross sectional view taken along the line 7C-7C in FIG. 7A.

As illustrated in FIG. 7A, at the longitudinal center portion of the layer regulation member 1, the blade 2 protrudes from the first support edge portion 31*a* of the holder 3. The portion of the blade 2 that protrudes from the first support edge portion 31*a* is capable of flexural deformation.

The free length L1 of the blade 2 at the longitudinal center portion of the layer regulation member 1 is the distance from the first support edge portion 31*a* of the holder 3 to the free end 2*a* of the blade 2. This distance is parallel to the width direction of the layer regulation member 1 (i.e., the width direction of the blade 2).

At the longitudinal end portion of the layer regulation member 1, the blade 2 protrudes from the second support edge portions 31*b* of the holder 3. The portion of the blade 2 that protrudes from the second support edge portions 31*b* is capable of flexural deformation.

The free length L2 of the blade 2 at the longitudinal end portion of the layer regulation member 1 is the distance from the second support edge portion 31*b* of the holder 3 to the free end 2*a* of the blade 2. This distance is parallel to the width direction of the layer regulation member 1 (i.e., the width direction of the blade 2).

As illustrated in FIGS. 7B and 7C, the free length L1 of the blade 2 at the longitudinal center portion of the layer regulation member 1 is longer than the free length L2 of the blade 2 at the longitudinal end portion of the layer regulation member 1 (L1>L2).

The blade 2 contacts the surface of the development roller 14 over a contact length H1. The contact length H1 is the length of the free end 2*a* of the blade 2.

The contact length H1 of the blade 2 is, for example, 223 mm, the free length L1 of the blade 2 is, for example, 16.5 mm, and the free length L2 is, for example, 14.6 mm.

In this case, the difference between the free lengths L1 and L2 of the blade 2 is 2.1 mm. Therefore, the ratio of the free length difference (L1−L2) of the blade 2 to the contact length H1 is (L1−L2)/H1×100=0.85%.

These values are just an example. The ratio ((L1−L2)/H1×100) of the free length difference (L1−L2) of the blade 2 to the contact length H1 is preferably in a range of 0.4% to 1.4%.

The distance between the pair of notches 34 of the holder 3 is the same as the contact length H1 of the blade 2. In the longitudinal direction of the holder 3, each of the second support edge portions 31*b* has the length H2.

The length H2 of each second support edge portion 31*b* of the holder 3 is, for example, 11.6 mm. Therefore, the ratio (H2/H1×100) of the length H2 of each second support edge portion 31*b* of the holder 3 to the contact length H1 is 10.4%.

These values are just examples. The ratio (H2/H1×100) of the length H2 of each second support edge portion 31*b* of the holder 3 to the contact length H1 is preferable in a range of 5% to 15%.

Figure 8:
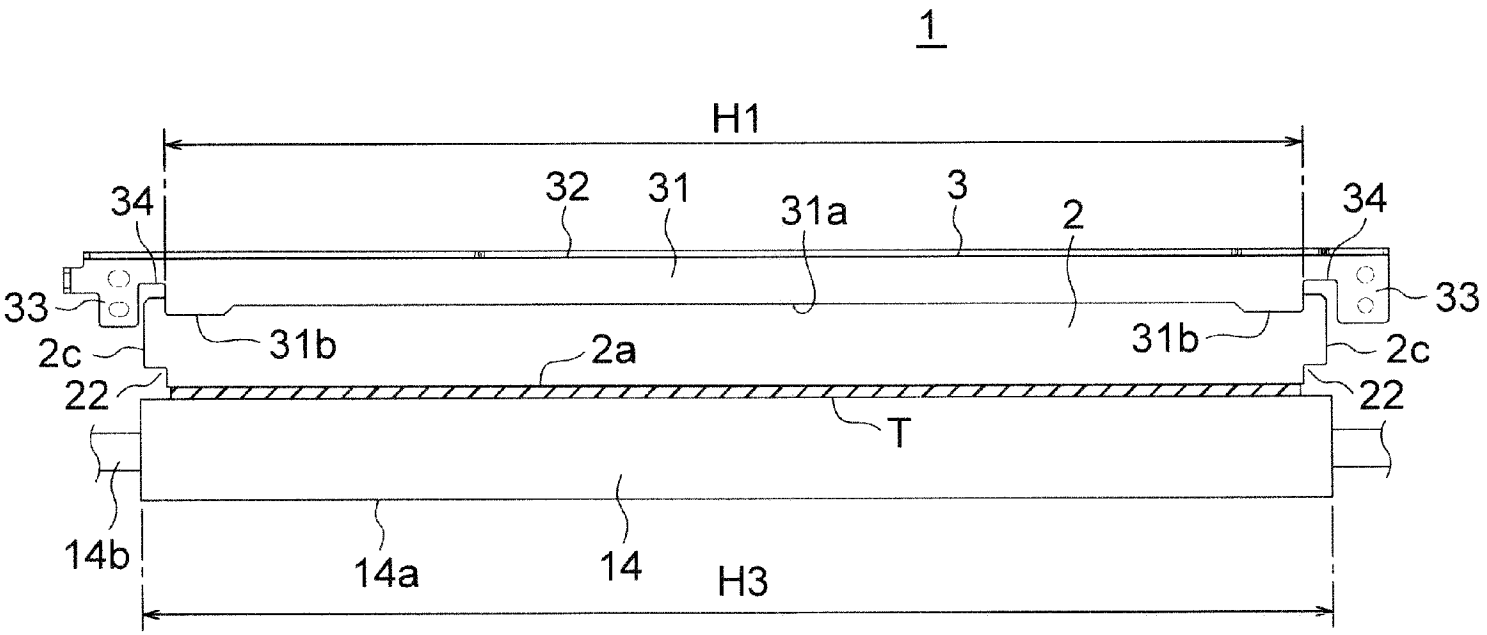
FIG. 8 is a diagram illustrating a view of the layer regulation member and a development roller according to a first embodiment.

FIG. 8 is a diagram illustrating a schematic view illustrating a state in which the layer regulation member 1 regulates the thickness of the toner layer on the surface of the development roller 14. The development roller 14 includes a shaft 14*b* and an elastic roller portion 14*a* formed on the outer circumference of the shaft 14*b*. The roller portion 14*a* is cylindrical, and the blade 2 of the layer regulation member 1 contacts the surface of the roller portion 14*a*.

The layer regulation member 1 is in contact with the development roller 14 over the contact length H1. The contact length H1 of the layer regulation member 1 is shorter than the axial length H3 of the roller portion 14*a* of the development roller 14 (H1<H3). Therefore, the free end 2*a* of the blade 2 of the layer regulation member 1 contacts the surface of the roller portion 14*a* of the development roller 14 over the entire length of the free end 2*a* in its longitudinal direction.

The toner layer (developer layer), indicated by the symbol T, is formed between the surface of the roller portion 14*a* of the development roller 14 and the free end 2*a* of the blade 2. The free end 2*a* of the blade 2 is pressed against the roller portion 14*a* of the development roller 14, thereby regulating the thickness of the toner layer T.

Figure 9A:
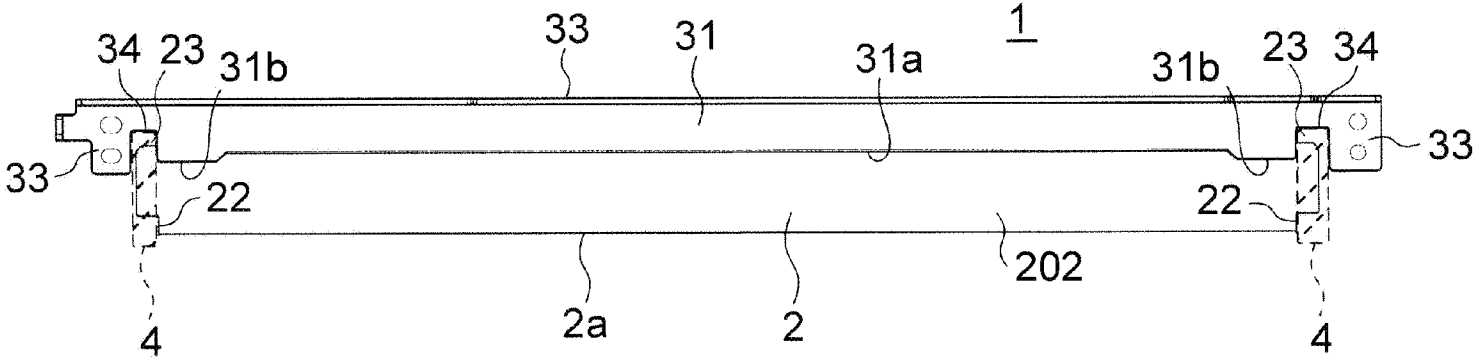
FIG. 9A is a diagram illustrating a view of the layer regulation member, the development roller, and seal members according to a first embodiment.

FIG. 9A is a diagram illustrating a schematic view of arrangements of sealing members 4. A pair of sealing members 4 are mounted near both longitudinal end portions of the holder 3, respectively. The sealing members 4 are arranged in the notches 34 of the holder 3 in such a manner that the sealing members 4 are in contact with the longitudinal end portions of the attachment surface 202 of the blade 2.

More specifically, each sealing member 4 is provided being in contact with an area (extended portion) extending along each longitudinal end 2*c* (each short side) of the blade 2 between the notches 22 and 23. In other words, the sealing members 4 are provided outside the free end 2*a* in the longitudinal direction of the blade 2.

Figure 9B:
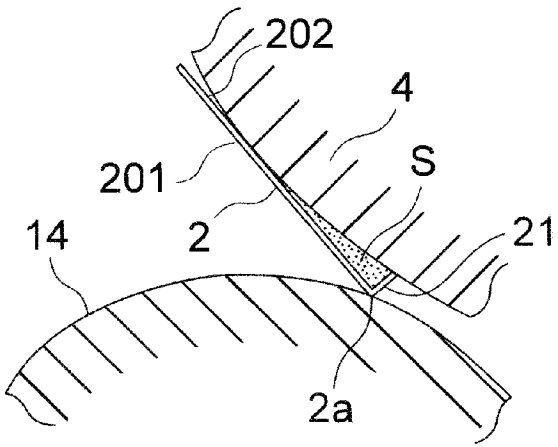
FIG. 9B is a diagram illustrating a schematic view of a contacting state between the layer regulation member, the development roller, and the sealing member according to a comparative configuration.

To the contrary, as illustrated in FIG. 9B as a comparative configuration, in a case where the seal member 4 is provided in an area overlapping with the free end 2*a*, that is, in a case where the seal member 4 contacts the bent portion 21 of the blade 2, a gap S is created between the seal member 4 and the blade 2, and thus the toner may leak through the gap S. The sealing member 4 may also affect the contact force between the blade 2 and the development roller 14.

In contrast, in a first embodiment, the sealing members 4 are disposed outside the free end 2*a* in the longitudinal direction of the blade 2. Accordingly, the sealing members 4 do not come into contact with the bent portion 21 of the blade 2. As a result, the gap S, which is created in the comparative configuration such as being illustrated in FIG. 9B, is not created in a first embodiment, and thus leakage of the toner through such a gap can be prevented. Also, the sealing members 4 are prevented from affecting the contact force between the blade 2 and the development roller 14.

(Operation of Image Formation Apparatus)

The operation of the image formation apparatus 100 is as follows. When a controller (a control unit) of the image formation apparatus 100 receives a print command and print data from a host device or an external device, the controller starts an image forming operation. First, the pickup roller 112 rotates to pull out a medium 6 from the medium tray 111, and the feed roller 113 rotates to feed the medium 6 into the conveyance path. Further, the conveyance rollers 115 and 116 rotate to convey the medium 6 to the transfer unit 120.

In the transfer unit 120, the transfer belt 121 runs by rotation of the drive roller 122, and the transfer belt 121 adsorbs and holds the medium 6 and conveys the medium 6 along the conveyance path. The medium 6 passes through the process units 10K, 100, 10M, and 10Y in this order.

A charging voltage, a developing voltage and a supply voltage are applied to the charging roller 12, the development roller 14 and the supply roller 15 of each process unit 10, respectively.

In each process unit 10, the photosensitive drum 11 rotates, and the charging roller 12, the development roller 14, and the supply roller 15 also rotate along with the rotation of the photosensitive drum 11. The charging roller 12 uniformly charges the surface of the photosensitive drum 11. The exposure head 13 exposes the surface of the photosensitive drum 11 with lights to thereby form an electrostatic latent image on the surface of the photosensitive drum 11.

In each process unit, the electrostatic latent image formed on the surface of the photosensitive drum 11 is developed with the toner attached on the development roller 14, and thus a toner image is formed on the surface of the photosensitive drum 11. The toner image formed on the surface of the photosensitive drum 11 is transferred to the medium 6 on the transfer belt 121 with a transfer voltage applied to the transfer roller 124.

In this manner, the toner images of the respective colors formed by the process units 10K, 100, 10M, and 10Y are sequentially transferred and thus superposed onto the medium 6. The medium 6 onto which the toner images of the respective colors have been transferred is further conveyed by the transfer belt 121 to the fixation unit 130.

In the fixation unit 130, the fixation roller 131 rotates and the pressure roller 132 also rotates following the fixation roller 131. The fixation roller 131 is heated to a predetermined fixation temperature by a built-in heater. The medium 6 conveyed from the transfer unit 120 to the fixation unit 130 is heated and pressurized when passing through the fixation nip between the fixation roller 131 and the pressure roller 132, and the toner images are fixed to the medium 6.

The medium 6 on which the toner images have been fixed is discharged by the discharging rollers 141 and 142 to the outside of the image formation apparatus 100 and loaded on the stacker 143. This completes the formation of the color image on the medium 6.

(Comparative Examples)

Figure 10:
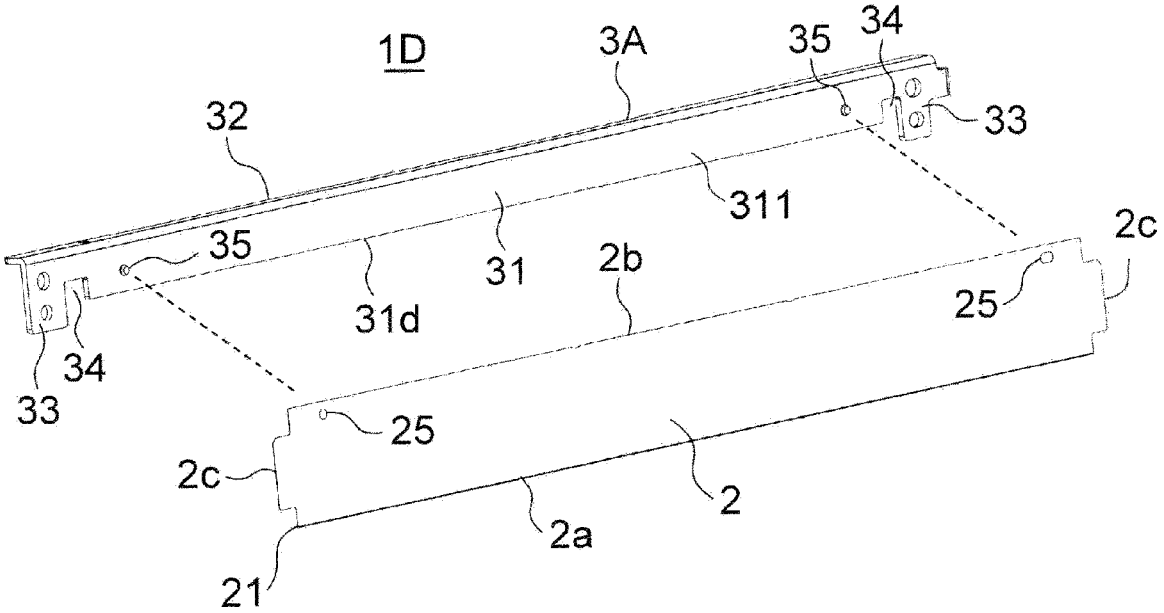
FIG. 10 is a diagram illustrating an exploded perspective view of the layer regulation member according to comparative examples.

FIG. 10 is a diagram illustrating an exploded perspective view of a layer regulation member 1D according to comparative examples. The layer regulation member 1D according to the comparative examples includes a blade 2 and a holder 3A. The blade 2 according to the comparative examples is the same as the blade 2 according to a first embodiment.

The holder 3A according to the comparative examples differs from the holder 3 according to a first embodiment in that the flat plate portion 31 does not have the second support edge portions 31*b* and the inclined edge portion 31*c*

(FIG. 6). In other words, an edge 31*d* (a support edge portion 31*d*) on the development roller 14 (FIG. 2) side of the flat plate portion 31 of the holder 3A according to the comparative example extends in a straight line over the entire length in the longitudinal direction of the flat plate portion 31.

Figure 11A:
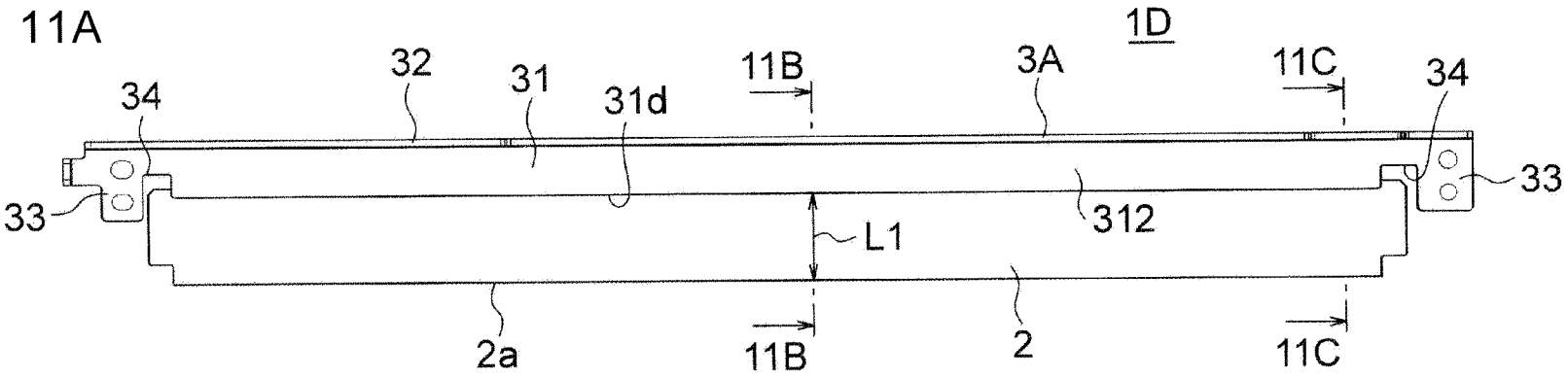
FIG. 11A is diagram illustrating a front view of the layer regulation member according to comparative examples.
Figure 11C:
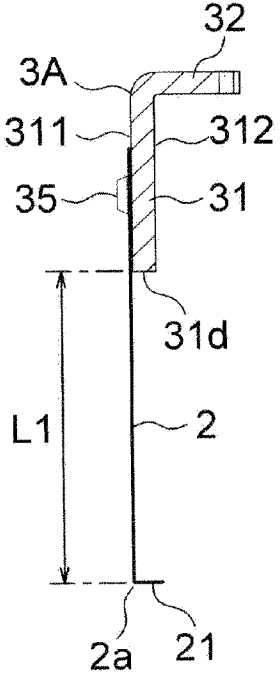
FIG. 11C is a diagram illustrating a cross sectional view of an end portion of the layer regulation member according to a comparative first example.
Figure 11B:
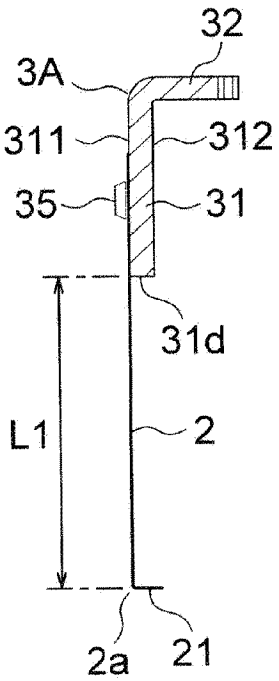
FIG. 11B is a diagram illustrating a cross sectional view of a center portion of the layer regulation member according to a comparative first example.

FIG. 11A is a view of the layer regulation member 1D according to the comparative example as seen in the direction indicated by the arrow A in FIG. 2. FIG. 11B is a diagram illustrating a cross sectional view taken along the line 11B-11B in FIG. 11A, and FIG. 11C is a diagram illustrating a cross sectional view taken along the line 11C-11C in FIG. 11A.

As illustrated in FIG. 11A, since the support edge portion 31*d* of the holder 3A linearly extends over the entire length in the longitudinal direction of the flat plate portion 31, the free length L1 of the blade 2 is constant over the entire length in the longitudinal direction of the layer regulation member 1D. In other words, as illustrated in FIGS. 11B and 11C, the free length L1 of the blade 2 is the same at the longitudinal center portion and at the longitudinal end portions of the layer regulation member 1D.

(Functions)

Next, functions according to a first embodiment is described in comparison with the comparative examples. As illustrated in FIG. 2, in the state where the layer regulation member 1 is mounted on the development unit 50, the free end 2*a* of the blade 2 contacts the surface of the development roller 14, and the blade 2 is deflected (i.e., curved). Due to the elastic force of the blade 2, the free end 2*a* of the blade 2 is pressed against the surface of the development roller 14 with a constant contact force. Here, the contact force refers to a contact force per unit length of the blade 2.

During the image formation described above, a toner layer is formed on the surface of the development roller 14 by toner supplied from the supply roller 15 to the surface of the development roller 14. As the toner layer on the development roller 14 passes between the layer regulation member 1 and the development roller 14, the thickness of the toner layer is regulated to a certain thickness. The toner layer on the development roller 14 is then attached to the latent image formed on the surface of the photosensitive drum 11 so as to form a toner image on the photosensitive drum 11, which is transferred from the photosensitive drum 11 to the medium 6 on the transfer belt 121 (FIG. 1).

In the comparative examples, the free length L1 of the blade 2 is constant over the entire length thereof in the longitudinal direction of the layer regulation member 1D, as illustrated in FIG. 11A.

In this case, a sufficient contact force of the blade 2 against the development roller 14 is obtained at the center portion of the longitudinal direction of the layer regulation member 1D, but the contact force of the blade 2 against the development roller 14 tends to be lowered in the longitudinal end portions of the layer regulation member 1D.

In the part where the contact force is lowered, the toner layer on the surface of the development roller 14 becomes thicker. As a result, the density of the image transferred to the medium 6 becomes uneven. Specifically, uneven density occurs so that the density at the end portion of the image becomes darker.

To the contrary, according to a first embodiment, as illustrated in FIG. 7A, the free lengths L2 of the blade 2 at the longitudinal end portions of the layer regulation member 1 are shorter than the free length L1 of the blade 2 at the longitudinal center portion of the layer regulation member 1. Therefore, at the longitudinal end portions of the layer regulation member 1, the contact force of the blade 2 against the development roller 14 is increased.

Specifically, the blade 2 can be considered as a cantilever with one end fixed by the holder 3 and the other end (free end) pressed against the development roller 14. The contact force P per unit length at which the free end 2*a* of the blade 2 is pressed against the development roller 14 can be determined by the following cantilever formula.

$$P = 3 \times E \times I \times W / L^3$$

Here, E is the modulus of longitudinal elasticity of the blade 2. I is a moment of inertia of area that depends on the cross-sectional shape of the blade 2. W is the amount of deflection of the blade 2 illustrated in FIG. 2. L is the free length of the blade 2.

From the above equation, it is understood that the shorter the free length L of the blade 2 is, the greater the contact force P becomes. Therefore, by making the free lengths L2 of the blade 2 at the longitudinal end portions of the layer regulation member 1 shorter than the free length L1 of the blade 2 at the longitudinal center portion of the layer regulation member 1, the contact force of the blade 2 against the development roller 14 can be made greater in the longitudinal end portions of the layer regulation member 1, and therefore the above-described reduction of the contact force at the longitudinal end portions of the layer regulation member 1 can be suppressed. As a result, non-uniformity in the thickness of the toner layer on the surface of the development roller 14 can be suppressed and unevenness in the density of the image can be reduced.

Figure 12:
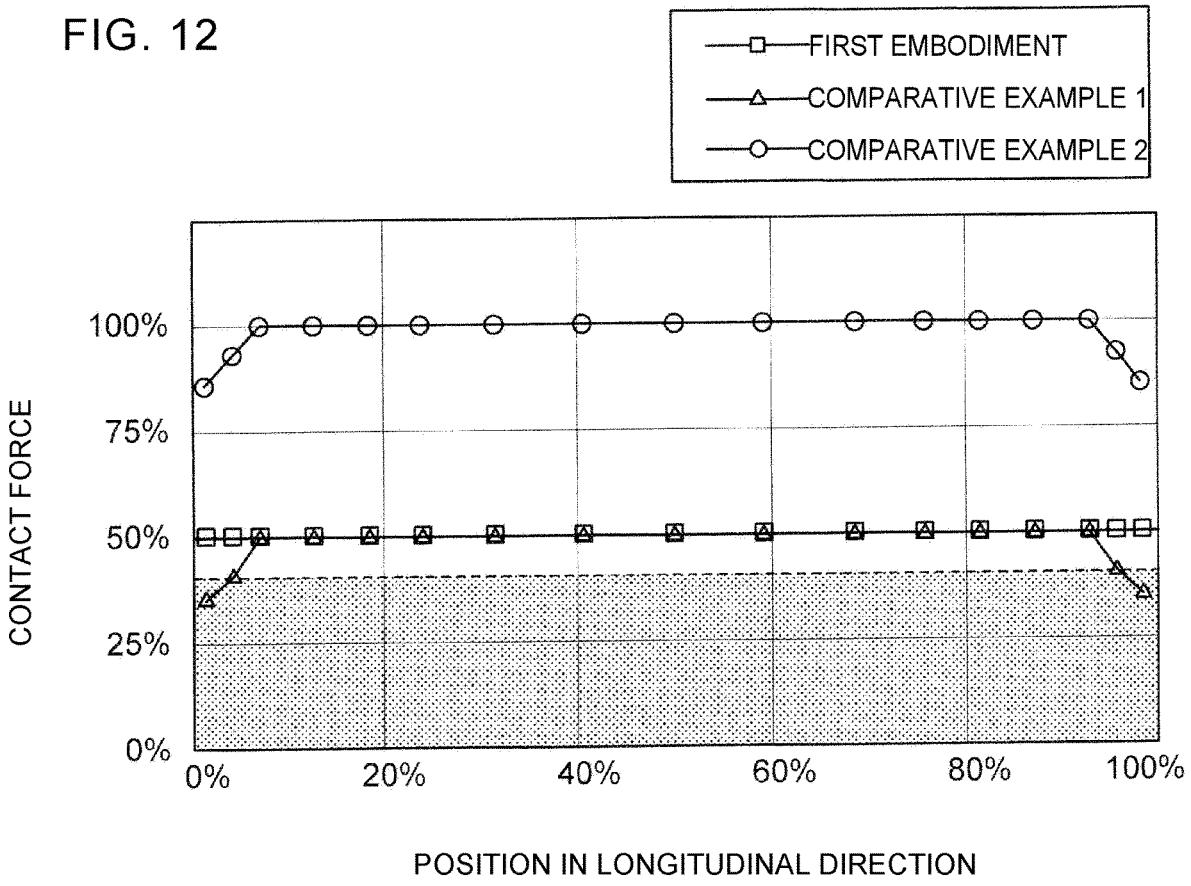
FIG. 12 is a graph illustrating distribution of contact force of the layer regulation member against the development roller in comparison with a first embodiment and comparative examples.

FIG. 12 is a graph illustrating the distribution of the contact force per unit length in the longitudinal direction of the blade 2. The horizontal axis represents the positions of the blade 2 in the longitudinal direction as ratios (%) to the length (contact length H1) of the blade 2 contacting the development roller 14. The vertical axis represents the contact force per unit length as ratios (%) to the contact force of the comparative example 2 (described below). The range of contact forces that causes unevenness in image density is indicated by hatching in FIG. 12.

FIG. 12 illustrates the data of the comparative examples 1 and 2 in addition to the data according to a first embodiment. In both comparative examples 1 and 2, the layer regulation member 1D described above with reference to FIG. 10 is used. The set value of the contact force of the blade 2 against the development roller 14 is 20 gf/cm in a first embodiment and the comparative example 1, and 40 gf/cm in the comparative example 2.

In general, the set value of the contact force of the blade 2 against the development roller 14 is 30 to 50 gf/cm. The set value of the contact force of 40 gf/cm in the comparative example 2 is included in this range (30 to 50 gf/cm).

In contrast, according to a first embodiment, the set value of the contact force of the blade 2 against the development roller 14 is lowered to 10 to 30 gf/cm to suppress wear of the blade 2 and the development roller 14 and thereby extend the service life of the development unit 50. The set value of the contact force according to a first embodiment illustrated in FIG. 12, 20 gf/cm, is included in this range (10 to 30 gf/cm). The set value of the contact force according to the comparative example 1 is the same as that according to the first embodiment.

As is apparent from FIG. 12, in the comparative examples 1 and 2, reduction in the contact force is observed at the longitudinal end portion of the blade 2. Specifically, reduction in the contact force is observed at each of the longitudinal end portions of the blade 2. In particular, in the comparative example 2, reduction in contact force that causes uneven density is observed at each of the longitudinal end portions of the blade 2.

In contrast, according to a first embodiment, there is no reduction in the contact force at the longitudinal end portions of the blade 2. In other words, it can be seen that the contact force of the blade 2 against the development roller 14 is made constant over the entire length in the longitudinal direction of the blade 2.

Thus, it can be seen that by making the free length L2 of the blade 2 at the longitudinal end portions of the layer regulation member 1 shorter than the free length L1 of the blade 2 at the longitudinal center portion of the layer regulation member 1, the reduction in the contact force between the blade 2 and the development roller 14 at the longitudinal end portions of the layer regulation member 1 can be suppressed.

Thus, by suppressing the reduction in the contact force between the blade 2 and the development roller 14 at the longitudinal end portions of the layer regulation member 1, the thickness of the toner layer on the surface of the development roller 14 can be made uniform and the unevenness in density of the image can be reduced.

According to a first embodiment, an inclined edge portion 31*c* is formed between the first support edge portion 31*a* and the second support edge portions 31*b* of the holder 3, so that no sudden level difference (no corner) is formed between the first support edge portion 31*a* and the second support edge portions 31*b*.

Since the blade 2 flexes with the first support edge portion 31*a* and the second support edge portions 31*b* of the holder 3 as fulcrums, if there is a sudden level difference between first support edge portion 31*a* and the second support edge portions 31*b*, the contact force between the blade 2 and the development roller 14 sharply increases at the particular point where the sudden level difference is provided. As a result, the toner layer may become thin in the particular point, resulting in uneven printing (uneven thread).

By forming the inclined edge portions 31*c* between the first support edge portion 31*a* and the second support edge portions 31*b*, changes in the contact force between the blade 2 and the development roller 14 in the particular points can be suppressed and uneven printing can be reduced.

When the ratio ((L1−L2)/H1×100) of the difference (L1−L2) of the free lengths L1 and L2 to the contact length H1 with which the blade 2 contacts the development roller 14 is in a range of 0.4% to 1.4%, the reduction in the contact force between the blade 2 and the development roller 14 as in the comparative example 1 of FIG. 12 can be sufficiently suppressed. As a result, unevenness in image density can be effectively reduced.

When the ratio (H2/H1×100) of the length H2 of each second support edge portion 31*b* of the holder 3 to the contact length H1 with which the blade 2 contacts the development roller 14 is in a range of 5% to 15%, a range in which reduction in the contact force between the blade 2 and the development roller 14 is likely to occur can be sufficiently managed. As a result, unevenness in image density can be effectively reduced.

In the above description, the free lengths L2 of the blade 2 at both longitudinal end portions of the layer regulation member 1 are the same as each other; however, those lengths may differ from each other in a modification. In the disclosure, the free length L2 of the blade 2 at least at one of the longitudinal end portions of the layer regulation member 1 may be shorter than the free length L1 of the blade 2 at the longitudinal center portion of the layer regulation member 1.

(Effects)

As described above, according to a first embodiment, the layer regulation member 1 includes the metal blade 2 and the holder (support member) 3 that supports the blade 2, and free lengths L2 of the blade 2 at the longitudinal end portions of the layer regulation member 1 are shorter than the free length L1 of the blade 2 at the longitudinal center portion of the layer regulation member 1 (L1>L2). Therefore, the reduction of the contact force between the blade 2 and the development roller 14 at the longitudinal end portions of the layer regulation member 1 can be suppressed, and unevenness of density of the image can be reduced.

Further, according to a first embodiment, the second support edge portions 31*b* of the holder 3 protrude more toward the development roller 14 than the first support edge portion 31*a*. This realizes a configuration in which the free length L2 of the blade 2 is shorter than the free length L1 without complicating the configuration of the layer regulation member 1.

Further, according to a first embodiment, the holder 3 includes the inclined edge portions 31*c* between the first support edge portion 31*a* and the second support edge portions 31*b*. Accordingly, there is no sudden level difference between the first support edge portion 31*a* and the second support edge portions 31*b*. As a result, changes in the contact force between the blade 2 and the development roller 14 in particular portions can be suppressed and uneven printing can be reduced.

Further, according to a first embodiment, the contact length H1 with which the blade 2 contacts the development roller 14 is shorter than the axial length H3 of the roller portion 14*a* of the development roller 14 (H1<H3). Accordingly, the free end 2*a* of the blade 2 contacts the roller portion 14*a* of the development roller 14 over the entire length of the longitudinal direction of the free end 2*a*. Therefore, due to the effect caused by the relationship between the free lengths L1 and L2 (L1>L2), the reduction in the contact force against the development roller 14 at the longitudinal end portions of the blade 2 can be suppressed, and the unevenness in density of the image can be reduced.

Further, according to a first embodiment, the blade 2 and the holder 3 are both made of metal and are fixed by welding. Accordingly, the heat generated by the friction between the blade 2 and the development roller 14 can be efficiently dissipated to the outside.

Second Embodiment

Next, a second embodiment is described. A development unit according to a second embodiment is configured in the same manner as the development unit 50 according to a first embodiment except for a configuration of a layer regulation member 1A.

Figure 13A:
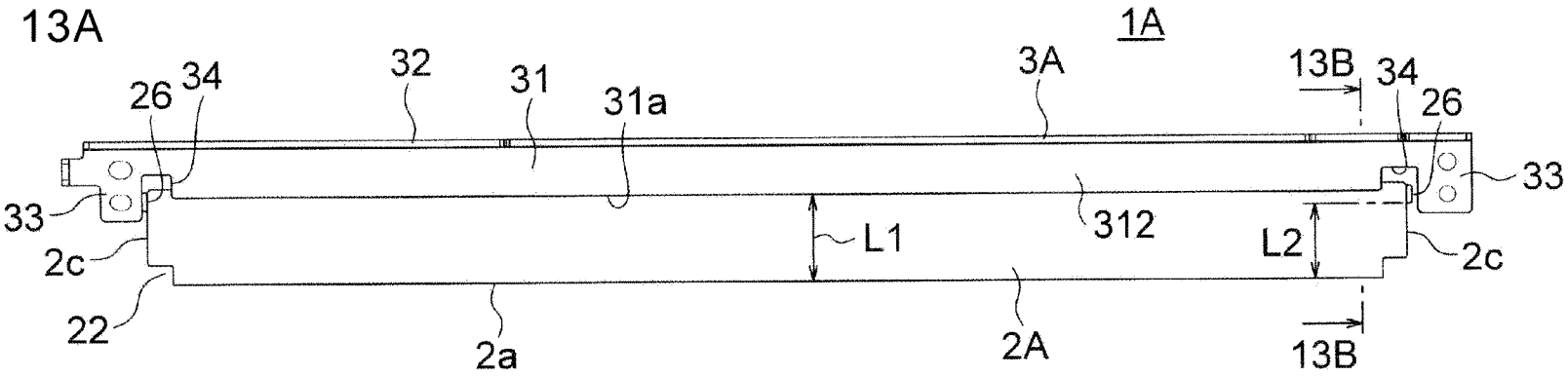
FIG. 13A is a diagram illustrating a front view of a layer regulation member according to a second embodiment.
Figure 13C:
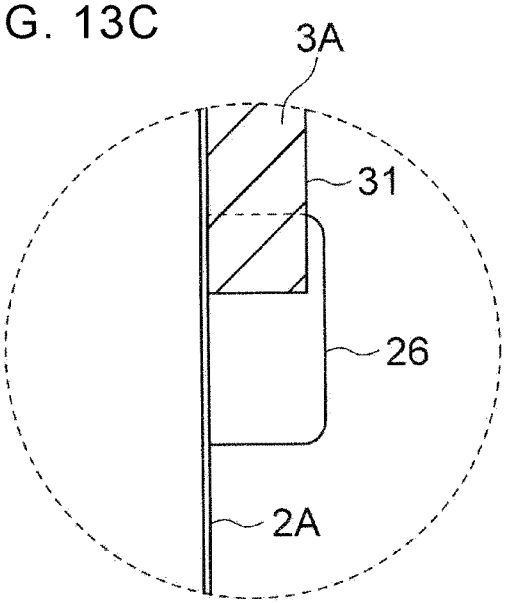
FIG. 13C is a diagram illustrating a cross sectional view of an end portion of the layer regulation member according to a second embodiment.
Figure 13B:
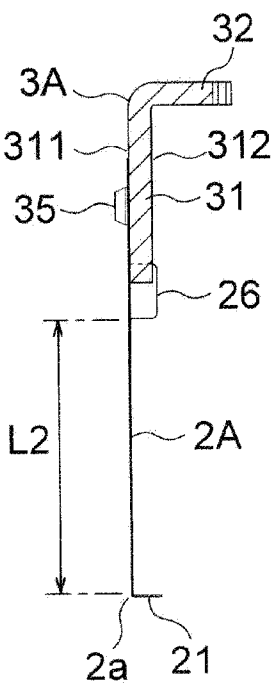
FIG. 13B is a diagram illustrating a cross sectional view of a center portion of the layer regulation member according to a second embodiment.

FIG. 13A is a diagram illustrating a view of the layer regulation member 1A according to a second embodiment as seen in the direction indicated by the arrow A in FIG. 2. FIG. 13B is a diagram illustrating a cross sectional view taken along the line 13*b*-13*b* in FIG. 13A. FIG. 13C is a diagram illustrating an enlarged cross sectional view of a part of FIG. 13B.

As illustrated in FIG. 13A, the layer regulation member 1A according to a second embodiment includes a blade 2A and a holder 3A. The holder 3A is configured in the same manner as the holder 3A according to the comparative examples described above (FIG. 10A).

At each of the longitudinal end portions of the layer regulation member 1A, a bending piece 26 as a bent portion is formed at the longitudinal end 2*c* (the short side 2*c*) of the blade 2A. As illustrated in FIG. 13B, the bending piece 26 is formed in a part of the longitudinal end 2*c* in the width direction of the blade 2A.

The bending piece 26 is formed continuously at the longitudinal end 2*c* of the blade 2A and is bent at a right angle to the rest of the blade 2A. The region in which the bending piece 26 is formed in the width direction of the blade 2A has a high flexural rigidity.

As illustrated in FIG. 13C, the bending piece 26 is located overlapping the flat plate portion 31 of the holder 3A when viewed in the longitudinal direction of the blade 2A. The portion of the blade 2A that is fixed to the flat plate portion 31 of the holder 3A is a portion that does not deflect or deform.

Because of such configuration, a portion of the longitudinal end portion 2*c* of the blade 2A that can be deflected and deformed is a portion of the longitudinal end portion 2*c* on the free end 2*a* side of the bending pieces 26 in the widthwise direction of the blade 2A. In other words, in the width direction of the blade 2A, the length L2 from the bending piece 26 to the free end 2*a* corresponds to the free length L2 of the blade 2A at the longitudinal end portions thereof.

Therefore, like a first embodiment, the configuration is obtained in which the free lengths L2 of the blade 2A at the longitudinal end portions of the layer regulation member 1A is shorter than the free length L1 of the blade 2A at the longitudinal center portion of the layer regulation member 1A (L1>L2). As a result, the reduction in the contact force between the blade 2A and the development roller 14 at the longitudinal end portions of the layer regulation member 1A can be suppressed, and the unevenness in density of the image can be reduced.

Except for the above described configurations, the layer regulation member 1A according to a second embodiment is configured in the same manner as the layer regulation member 1 according to a first embodiment.

Although the bending pieces 26 of the blade 2A have the same shape at both longitudinal end portions of the layer regulation member 1A in this example, the shapes of the bending pieces 26 may be different from each other in the disclosure. Also in the disclosure, the bending piece 26 may be provided on the blade 2 at least at one of the end portions in the longitudinal direction of the layer regulation member 1.

As described above, according to a second embodiment, the blade 2A includes the bending pieces 26 at the longitudinal end portions of the layer regulation member 1A, and the distance from the bending piece 26 to the free end 2*a* of the blade 2A (that is, the free length L2 of the blade 2A at the longitudinal end portions of the layer regulation member 1A) is shorter than the free length L1 of the blade 2A at the longitudinal center portion of the layer regulation member 1A (L1>L2). Therefore, like a first embodiment, the reduction in the contact force between the blade 2A and the development roller 14 at the longitudinal end portions of the layer regulation member 1A can be suppressed, and the density unevenness of the image can be reduced.

In addition, a second embodiment can simplify the configuration of the holder 3A, thereby reducing the manufacturing cost.

Third Embodiment

Next, a third embodiment is described. A development unit according to a third embodiment is configured in the same manner as the development unit 50 according to a first embodiment except for a configuration of a layer regulation member 1B.

Figure 14A:
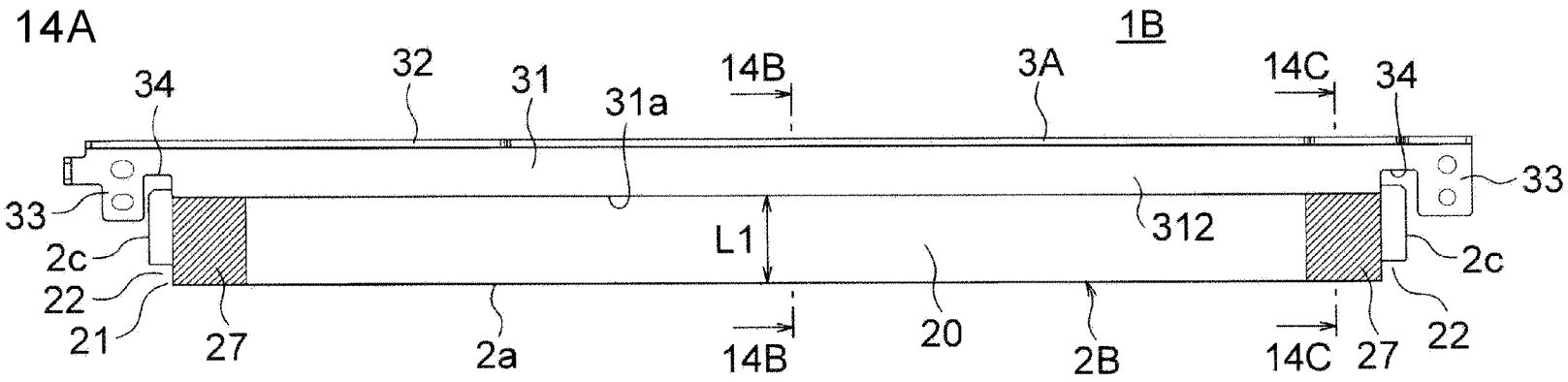
FIG. 14A is a diagram illustrating a front view of a layer regulation member according to a third embodiment.
Figure 14E:
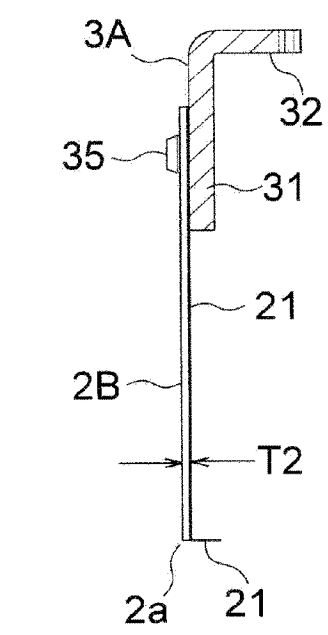
FIG. 14E is a diagram illustrating a cross sectional view of another configuration example of the layer regulation member according to a third embodiment.
Figure 14D:
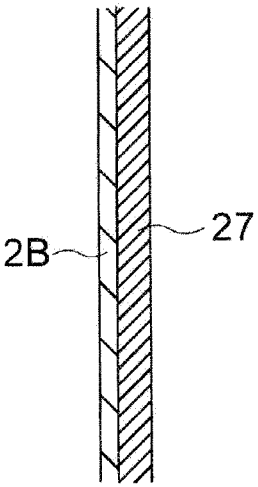
FIG. 14D is a diagram illustrating an enlarged cross sectional view of a part of the layer regulation member according to a third embodiment.
Figure 14C:
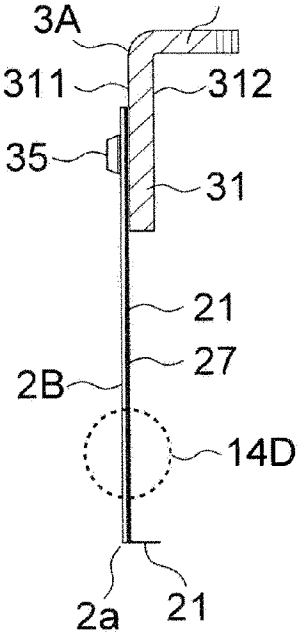
FIG. 14C is a diagram illustrating a cross sectional view of an end portion of the layer regulation member according to a third embodiment.
Figure 14B:
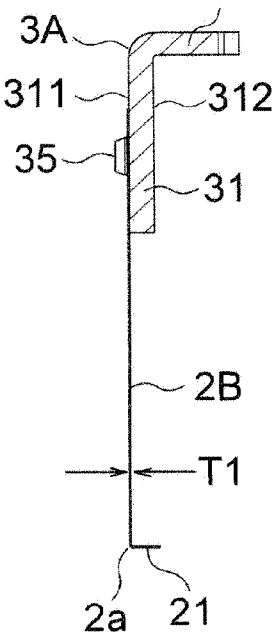
FIG. 14B is a diagram illustrating a cross sectional view of a center portion of the layer regulation member according to a third embodiment.

FIG. 14A is a diagram illustrating a view of the layer regulation member 1B according to a third embodiment as seen in the direction indicated by the arrow A in FIG. 2. FIG. 14B is a diagram illustrating a cross sectional view taken along the line 14B-14B in FIG. 14A. FIG. 14C is a diagram illustrating a cross sectional view taken along the line 14C-14C in FIG. 14A. FIG. 14D is a diagram illustrating an enlarged cross sectional view of a portion enclosed by the circle 14D in FIG. 14C. FIG. 14E is a diagram illustrating a cross sectional view at the same position as FIG. 14C, to illustrate another configuration example of the layer regulation member 1B.

As illustrated in FIG. 14A, the layer regulation member 1B according to a third embodiment includes a blade 2B and a holder 3A. The holder 3A is configured in the same manner as the holder 3A according to the comparative examples described above.

As illustrated in FIG. 14B, at a longitudinal center portion of the layer regulation member 1B, the blade 2B is provided with no reinforcing portion 27. On the other hand, as illustrated in FIG. 14C, at both longitudinal end portions of the layer regulation member 1B, reinforcing portions 27 are provided on the surface of the blade 2B.

The reinforcing portions 27 are obtained, for example, by attaching sheet metal or film to the surface of the blade 2B or by applying resin coating to the surface of the blade 2B. Instead of attaching such a member to the blade 2B, the thickness T2 of the longitudinal end portions of the blade 2B may be made thicker than the thickness T1 of the longitudinal center portion of the blade 2B (FIG. 14B), as illustrated in FIG. 14E.

That is, in a third embodiment, the flexural rigidity of the blade 2B at the longitudinal end portions of the layer regulation member 1B is greater than the flexural rigidity of the blade 2B at the longitudinal center portion of the layer regulation member 1B.

Unlike first and second embodiments, according to a third embodiment, the free length of the blade 2B is constant over the entire length in the longitudinal direction of the layer regulation member 1B. However, since the flexural rigidity of the blade 2B at the longitudinal end portions of the layer regulation member 1B is greater than that at the longitudinal center portion, the reduction in the contact force between the blade 2B and the development roller 14 at the longitudinal end portions of the layer regulation member 1B can be suppressed and the uneven density of the image can be reduced.

Except for the above described configurations, the layer regulation member 1B according to a third embodiment is configured in the same manner as the layer regulation member 1 according to a first embodiment.

Note that, in a third embodiment, the reinforcing portions 27 provided on the blade 2B at both longitudinal end portions of the layer regulation member 1B have the same configuration, but the configurations of the reinforcing portions 27 may differ from each other in a modification. In the disclosure, the reinforcing portion 27 may be provided on the blade 2B at least at one of the end portions in the longitudinal direction of the layer regulation member 1.

As described above, according to a third embodiment, the flexural rigidity of the blade 2B at the longitudinal end portions of the layer regulation member 1B is greater than that of the blade 2B at the longitudinal center portion of the layer regulation member 1B. Accordingly, the reduction in the contact force between the blade 2B and the development roller 14 at the longitudinal end portions of the layer regulation member 1B is suppressed, and unevenness in density of an image can be reduced.

Fourth Embodiment

Next, a fourth embodiment is described. A development unit according to a fourth embodiment is configured in the same manner as the development unit 50 of a first embodiment except for a configuration of a layer regulation member 1C.

Figure 15:
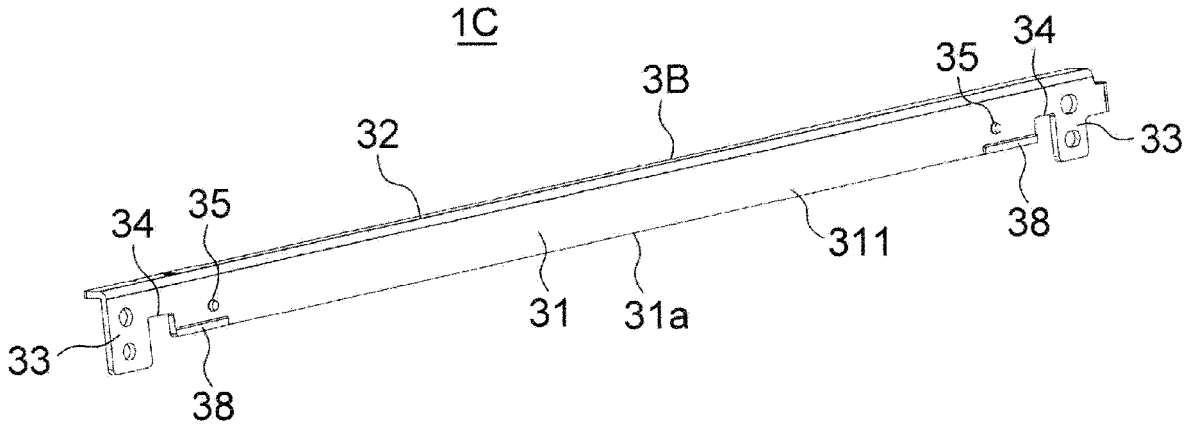
FIG. 15 is a diagram illustrating a perspective view of a layer regulation member according to a fourth embodiment.

FIG. 15 is a diagram illustrating a perspective view of a layer regulation member 1C according to a fourth embodiment. As illustrated in FIG. 15, the layer regulation member 1C according to a fourth embodiment includes a blade 2 and a holder 3B. The blade 2 is configured in the same manner as the blade 2 according to a first embodiment described above.

At the longitudinal end portions of the layer regulation member 1C, projected portions 38 (or convex portions) are formed on an attachment surface 311 of a flat plate portion 31 of the holder 3B. The projected portions 38 are formed along a support edge portion 31*a* of the holder 3B. The projected portions 38 may be formed integrally with the flat plate portion 31 of the holder 3B, or by affixing a sheet metal or a film to the attachment surface 311 of the flat plate portion 31.

Figure 16A:
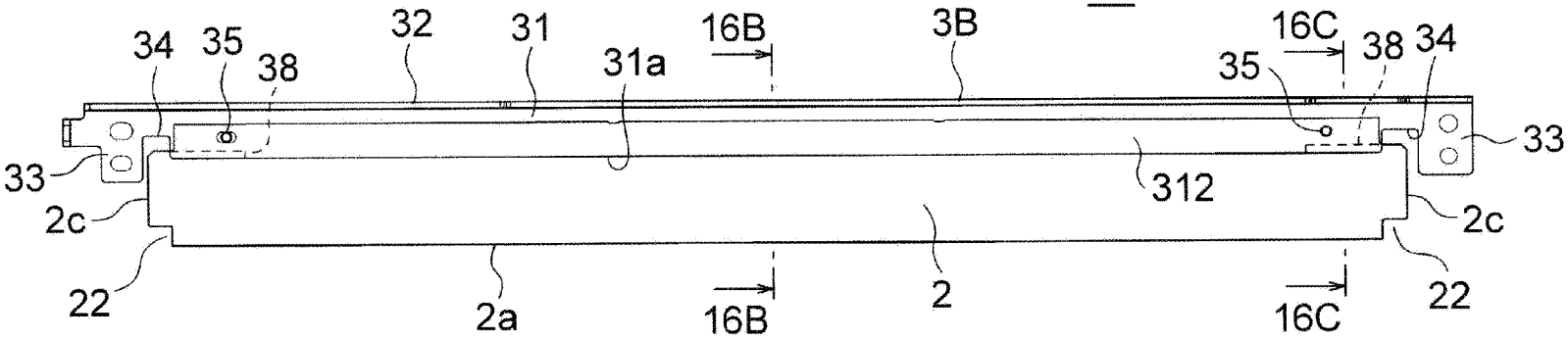
FIG. 16A is a diagram illustrating a front view of the layer regulation member according to a fourth embodiment.
Figure 16D:
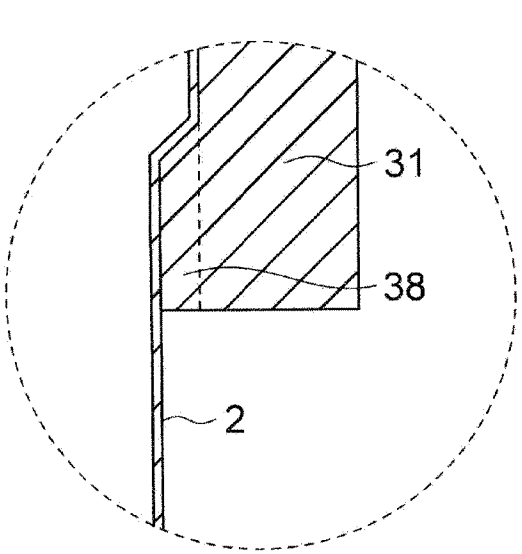
FIG. 16D is a diagram illustrating an enlarged cross sectional view of a part of the layer regulation member according to a fourth embodiment.
Figure 16C:
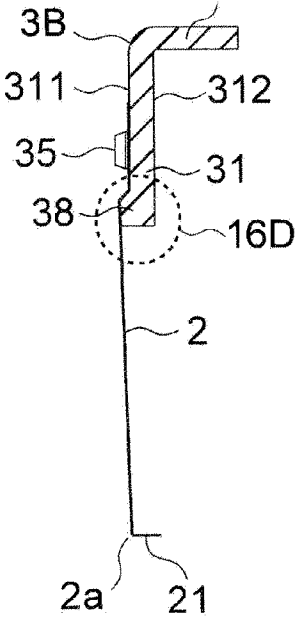
FIG. 16C is a diagram illustrating a cross sectional view of the end portion of the layer regulation member according to a fourth embodiment.
Figure 16B:
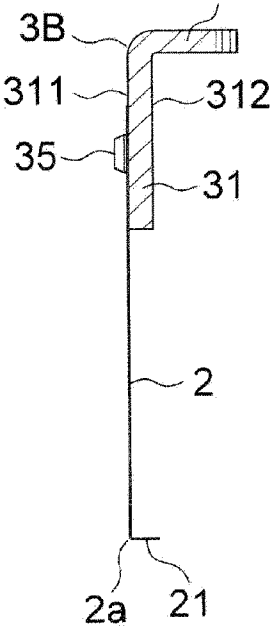
FIG. 16B is a diagram illustrating a cross sectional view of a center portion of the layer regulation member according to a fourth embodiment.

FIG. 16A is a view of the layer regulation member 1C in the direction indicated by the arrow A in FIG. 2. FIG. 16B is a diagram illustrating a cross sectional view taken along the line 16B-16B in FIG. 16A. FIG. 16C is a diagram illustrating a cross sectional view taken along the line 16C-16C in FIG. 16A. FIG. 16D is a diagram illustrating an enlarged cross sectional view of a portion enclosed by the circle 16D in FIG. 16C.

As illustrated in FIG. 16A, the support edge portion 31*a* of the holder 3B is formed in a straight line over the entire length of the flat plate portion 31. Therefore, the free length of the blade 2 is constant over the entire length in the longitudinal direction of the layer regulation member 1C.

At the longitudinal center portion of the layer regulation member 1C, the blade 2 is fixed to the attachment surface 311 of the holder 3B, as illustrated in FIG. 16B. In contrast, at the longitudinal end portions of the layer regulation member 1C, the blade 2 is fixed to the projected portions 38 of the holder 3B, as illustrated in FIGS. 16C and 16D.

Therefore, the deflection amount W of the blade 2 at the longitudinal end portions of the layer regulation member 1C is larger than the deflection amount W of the blade 2 at the longitudinal center portion of the layer regulation member 1C by the protrusion amount of the projected portions 38.

As described in a first embodiment, the contact force P between the blade 2 and the development roller 14 is expressed by $P=3\times E\times I\times W/L^3$.

As the deflection amount W increases, the contact force P increases in proportion to the increase of the deflection amount W. Therefore, the contact force between the blade 2 and the development roller 14 can be increased at the longitudinal end portions of the layer regulation member 1C. As a result, the reduction in the contact force between the blade 2 and the development roller 14 at the longitudinal end portions of the layer regulation member 1C can be suppressed, and the unevenness in density of the image can be reduced.

Except for the above described configurations, the layer regulation member 1C according to a fourth embodiment is configured in the same manner as the layer regulation member 1 according to a first embodiment.

In a fourth embodiment, the projected portions 38 provided on the holder 3B at both end portions in the longitudinal direction of the layer regulation member 1C have the same shape, but the shapes of the projected portions 38 may be different from each other in a modification. In the disclosure, the projected portion 38 may be provided on the holder 3B at least at one of the end portions in the longitudinal direction of the layer regulation member 1.

As described above, according to a fourth embodiment, the deflection amount W of the blade 2 at the longitudinal end portions of the layer regulation member 1C is larger than the deflection amount W of the blade 2 at the longitudinal center portion of the layer regulation member 1C. Therefore, the reduction in the contact force between the blade 2B and the development roller 14 at the longitudinal end portions of the layer regulation member 1C can be suppressed, and the unevenness in density of the image can be reduced.

In the disclosure, above-described first through fourth embodiments may be combined as appropriate. For example, in a modification, the flexural rigidity of the blade 2 at the longitudinal end portions of the layer regulation member 1 according to a first embodiment may be made greater than the flexural rigidity of the blade 2 at the longitudinal center portion of the layer regulation member 1.

In one or more embodiments described above, the case has been described in which the image formation apparatus forms color images. However, the disclosure can also be applied to an image formation apparatus that forms monochrome (black and white) images. Also, the disclosure can be applied to a development unit and an image formation apparatus of various types (for example, a copying machine, a facsimile machine, a printer, a multifunction circumferential, etc.) that forms an image on a medium by using an electrophotographic method.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development unit comprising:

a developer carrier configured to carry developer on a surface thereof;

a layer regulation member being elongate in a direction and provided facing the developer carrier; and a frame supporting the developer carrier and the layer regulation member, wherein the layer regulation member comprises a metal blade that contacts the developer carrier and a support member attached to the frame and supporting the blade, wherein the support member includes a support edge portion that serves as a fulcrum point for flexion of the blade, a free end of the blade is in direct contact with the developer carrier, a free length of the blade is defined as a length in a direction orthogonal to a longitudinal direction of the blade from the support edge portion to the free end of the blade, the free length of the blade at a longitudinal end portion of the blade is shorter than the free length of the blade at a longitudinal center portion of the blade, and one or more of: the free length of the blade at the longitudinal center portion of the blade, the free length of the blade at the longitudinal end portion of the blade, and a length of a portion of the blade that contacts the developer carrier in the longitudinal direction are set such that an expression: $0.4\% \leq (L1-L2)/H1 \times 100 \leq 1.4\%$, in which: H1 represents the length of the portion of the blade that contacts the developer carrier in the longitudinal direction; L1 represents the free length of the blade at the longitudinal center portion of the blade; and L2 represents the free length of the blade at the longitudinal end portion of the blade, is satisfied.

2. The development unit according to claim 1, wherein the support edge portion of the support member includes a first support edge portion that serves as a fulcrum point for flexion of the blade at the longitudinal center portion and a second support edge portion that serves as a fulcrum point for flexion of the blade at the longitudinal end portion, and the second support edge portion extends toward the developer carrier further than the first support edge portion.

3. The development unit according to claim 2, wherein the support edge portion of the support member includes an inclined edge portion that is inclined with respect to the longitudinal direction, between the first support edge portion and the second support edge portion.

4. The development unit according to claim 1, wherein the blade includes, at the longitudinal end portion of the blade, a bent portion, wherein the bent portion and the support member are overlapped with each other in the longitudinal direction.

5. The development unit according to claim 4, wherein the free length of the blade at the longitudinal end portion of the blade is a length from the bent portion of the blade to the free end of the blade being in direct contact with the developer carrier.

6. The development unit according to claim 1, wherein the length of the portion of the blade that contacts the developer carrier in the longitudinal direction is shorter than a length of the surface of the developer carrier in the longitudinal direction.

7. The development unit according to claim 1, wherein the support member is made of metal, and the blade and the support member are fixed by welding.

8. The development unit according to claim 1, wherein the blade includes an extended portion extending outwardly in the longitudinal direction further than the portion of the blade that contacts the developer carrier, and a sealing member is disposed at the extended portion of the blade.

9. An image formation unit comprising:

the development unit according to claim 1; and an image carrier configured to carry a latent image, which is to be developed with the developer supplied by the development unit, so as to form a developer image.

10. An image formation apparatus comprising:

the image formation unit according to claim 9;

a transfer unit configured to transfer the developer image formed by the image formation unit to a medium; and a fixation unit configured to fix the developer image to the medium.

* * * * *